US005881958A

United States Patent [19]

Asakawa et al.

[11] Patent Number: 5,881,958

[45] Date of Patent: Mar. 16, 1999

[54] FLUID DISCHARGE NOZZLE

[75] Inventors: Hiroyoshi Asakawa, Nishinomiya; Akihiko Tanigaki, Hyogo-ken, both of Japan

[73] Assignee: Kyoritsu Gokin Mfg. Co., Ltd., Japan

[21] Appl. No.: 699,115

[22] Filed: Aug. 16, 1996

[30] Foreign Application Priority Data

Feb. 14, 1996 [JP] Japan ..... 8-026432

[51] Int. Cl.[6] ..... A62C 31/02

[52] U.S. Cl. ..... 239/589; 239/592; 239/597; 239/599

[58] Field of Search ..... 239/589, 592–4, 239/597, 598, 599

[56] References Cited

U.S. PATENT DOCUMENTS

| | | | |
|---|---|---|---|
| 1,192,901 | 8/1916 | Irish | 239/589 |
| 2,701,412 | 2/1955 | Wahlin | 239/599 |
| 3,647,147 | 3/1972 | Cook | 239/599 |
| 5,143,302 | 9/1992 | Sakuma | 239/599 |

FOREIGN PATENT DOCUMENTS

| | | | |
|---|---|---|---|
| 415512 | 9/1910 | France | 239/592 |
| 58-88050 | 5/1983 | Japan . | |
| 63-221860 | 9/1988 | Japan . | |
| 235953 | 2/1990 | Japan . | |
| 235954 | 2/1990 | Japan . | |
| 2152567 | 6/1990 | Japan . | |
| 2172547 | 7/1990 | Japan . | |
| 62114673 | 8/1991 | Japan | B05B 7/04 |
| 3238060 | 10/1991 | Japan . | |
| 3242459 | 10/1991 | Japan . | |
| 5329402 | 12/1993 | Japan . | |
| 988607 | 3/1997 | Japan . | |
| 6492 | 3/1914 | United Kingdom | 239/592 |

*Primary Examiner*—Andres Kashnikow
*Assistant Examiner*—Lisa Ann Douglas
*Attorney, Agent, or Firm*—Webb Ziesenheim Bruening Logsdon Orkin & Hanson, P.C.

[57] ABSTRACT

A fluid discharge nozzle includes a nozzle tip defining a spout for jetting fluid at a jet angle. Wall surfaces surround the spout and extend downstream with respect to a jetting direction. The wall surfaces contact free surfaces of the fluid jetting out of the spout. Fluid jets produce negative pressure regions inwardly of a forward end surface of the nozzle tip.

34 Claims, 11 Drawing Sheets

FLUID DISCHARGE NOZZLE

BACKGROUND OF THE INVENTION

1. Field of the Invention

This invention relates to fluid discharge nozzles, and more particularly to a fluid discharge nozzle having a nozzle tip defining a spout for jetting out, at a jet angle, fluid such as liquid, gas or a mixture of liquid and gas.

2. Description of the Related Art

A fluid discharge nozzle of the type that jets out a mixture of liquid and gas is used, for example, to spray a mixture of pressurized water and pressurized air toward rolled steel plate to cool the steel, or to spray a mixture of water and chemical to plants in vegetable gardens or orchards. A nozzle of the type that jets out only gas is used, for example, to jet out air toward a steel surface to remove therefrom water, oil, stains and the like, or to dry the steel surface, or to cool the steel in a heat treatment. A nozzle of the type that jets out only liquid is used, for example, to jet out pressurized water toward a surface of rolled steel plate to remove scales therefrom.

Such a fluid discharge nozzle is required to jet out fluid with a maximum degree of dispersion while maintaining a jet pattern at a predetermined jet angle toward a transversely elongated or circular region selected according to a use mode. That is, the fluid is required to jet out with little density variations in a given position within a jetting region.

Where, for example, a mixture of pressurized water and pressurized air is sprayed in a thin flat jet pattern toward rolled steel plate to cool the steel plate, the mixture is required to jet out with water particles dispersed as much as possible. The steel plate tends to be quenched locally to affect its quality if the density of water particles is high in a middle position in a direction of spray thickness in the jetting region, and low in peripheral positions thereof.

FIGS. 26 through 28 show a conventional fluid discharge nozzle designed to meet the above requirement.

This fluid discharge nozzle has a slit-like spout 01 formed in a nozzle body 02 for spraying a mixture E of water and air in a flat sector pattern. The spout 01 is surrounded by an outlet edge 03 continuous to spray guide surfaces 04 diverging radially outward in a downstream direction of the jet. The mixture E jetting out of the spout 01 is guided by the spray guide surfaces 04. Water particles are dispersed toward the spray guide surfaces 04, i.e. outward in a direction of spray thickness perpendicular to the longitudinal direction of the spout 01, with expansion of the air from a compressed state and by a dispersing action of negative pressure regions 05 occurring on the spray guide surfaces 04 as a result of air discharge from the spout 01. The mixture E jets out in a well dispersed state while maintaining the flat sector jet pattern. (See Japanese Patent Publication Kokai S62-114673, for example.)

The conventional construction utilizes the dispersing action of negative pressure regions 05 resulting from the fluid discharge through the spout 01 as noted above. However, ambient air flows 06 generated by the discharge of fluid E from the spout 01 tend to move along the spray guide surfaces 04 toward the spout 01 since the negative pressure regions 05 occur on the spray guide surfaces 04 continuous from the outlet edge 03 of the spout 01 and diverging radially outward in the downstream direction of the jet. Thus, strong negative pressure regions 05 are problematic. Then, where, for example, a mixture of pressurized water and pressurized air is sprayed in a thin flat jet pattern, water particles cannot be dispersed sufficiently in the direction of spray thickness. That is, the fluid E cannot be sprayed in an effectively dispersed state by positively using the dispersing action of the negative pressure regions 05 while maintaining the desired jet pattern.

Moreover, since the negative pressure regions 05 are formed downstream of the outlet edge 03 of the spout 01, the fluid E jetting out of the spout 01 tends to move past the negative pressure regions 05 without being sufficiently drawn thereto. In this sense also, the fluid E cannot be sprayed in an effectively dispersed state by positively using the dispersing action of the negative pressure regions 05.

SUMMARY OF THE INVENTION

This invention has been made having regard to the state of the art noted above, and its object is to provide a fluid discharge nozzle having an improved configuration of a spout outlet to spray fluid such as a mixture of liquid and gas in an effectively dispersed state by positively using a dispersing action of negative pressure regions while maintaining a desired jet pattern.

The above object is fulfilled, according to the present invention, by a fluid discharge nozzle comprising a nozzle tip defining a spout for jetting fluid at a jet angle, and wall surfaces extending further than the spout in a jetting direction in positions spaced from an outlet edge of the spout in a direction crossing the jetting direction, thereby causing fluid jets to produce negative pressure regions inwardly of a forward end surface of the nozzle tip.

With the above construction, as shown in FIG. 3, for example, fluid jets readily produce strong negative pressure regions 7 inwardly of wall surfaces 5*a*, with little chance of ambient air flowing inside the wall surfaces 5*a* due to the fluid jets from spout 1.

Thus, the fluid such as liquid, gas or a mixture of liquid and gas is positively dispersed due to the negative pressure regions. The fluid is discharged in an effectively dispersed state while maintaining a desired jet pattern.

Particularly where the fluid is gas or a mixture of liquid and gas, the fluid is discharged while drawing the gas expanding from a compressed state toward the negative pressure regions. In the case of a mixture of liquid and gas, the gas containing particles of the liquid is effectively dispersed as above. Where a mixture of pressurized water and pressurized air is sprayed in a thin flat jet pattern, as shown reference "a" in FIG. 7, for example, particles of water are effectively dispersed in a direction of spray thickness. Reference "b" in FIG. 7 denotes a water distribution according to the prior art.

The fluid may be liquid or a mixture of liquid and gas, in which case the liquid is effectively dispersed into mist form.

The spout may have an inlet end communicating with a passage converging toward the inlet end.

With this construction, the fluid having passed through the passage tends to flow into the spout in a state having velocity components crossing the jetting direction. Such velocity components cause the fluid entering the spout to jet out in a still more effectively dispersed state.

The wall surfaces may be arranged to contact free surfaces of the fluid jetting out of the spout.

Then, ambient air flows due to the fluid jets from the spout are effectively prevented from flowing inwardly between the wall surfaces and the free surfaces of the fluid. This results in an advantage of facilitating generation of strong negative pressure regions inwardly of the wall surfaces.

The wall surfaces may surround an entire circumference of the outlet edge.

This construction promotes dispersion of the entire fluid jetting out of the spout.

The wall surfaces may surround part of the outlet edge.

With this construction, part of the fluid may be dispersed in a desired state as necessary.

The wall surfaces may extend parallel to a center axis of the spout.

Compared with wall surfaces inclined to diverge outward as they extend downstream with respect to the jetting direction, this construction effectively prevents ambient air from flowing inwardly of the wall surfaces, thereby facilitating generation of strong negative pressure regions. Compared with wall surfaces inclined to converge as they extend downstream, this construction imparts less resistance to the fluid jets. The above wall surfaces have a further advantage of being easy to shape.

The wall surfaces may be inclined inward in the jetting direction.

As shown in FIG. 13, for example, this construction effectively prevents ambient air from flowing inwardly of the wall surfaces 5*a*, thereby facilitating generation of strong negative pressure regions 7.

The wall surfaces may be curved inward in the jetting direction.

As shown in FIG. 13, for example, this construction generates vortices 7*a* in the negative pressure regions 7, which vortices occur steadily along the curved wall surfaces 5*a*. Consequently, the negative pressure regions 7 may be formed in stable positions to promote stability of fluid dispersion.

Groove-like indents may be formed between the wall surfaces and the outlet edge, the indents defining recessed surfaces recessed upstream of the outlet edge with respect to the jetting direction.

As shown in FIG. 3, for example, this construction facilitates generation of negative pressure regions 7 offset upstream of the outlet edge 3 with respect to the jetting direction. The fluid immediately after exiting the spout 1, particularly the gas expanding from a compressed state is sufficiently drawn toward the negative pressure regions 7. In this way, the negative pressure regions 7 positively promote dispersion.

The recessed surfaces may be curved inward as seen longitudinally of the indents.

As shown in FIG. 3, for example, this construction generates vortices 7*a* in the negative pressure regions 7, which vortices occur steadily along the curved wall surfaces 6*a*. Consequently, the negative pressure regions 7 may be formed in stable positions to promote stability of fluid dispersion.

The recessed surfaces and the wall surfaces may form a continuous curved surface as seen longitudinally of the indents.

As shown in FIG. 13, for example, this construction generates vortices 7*a* in the negative pressure regions 7, which vortices occur steadily along the curved surfaces 6*a* and wall surfaces 5*a*. Consequently, the negative pressure regions 7 may be formed in stable positions to promote stability of fluid dispersion.

The outlet edge may be elongated in a direction crossing the jetting direction.

This construction positively promotes dispersion of water particles in the direction of spray thickness while a mixture of air and water, for example, is sprayed in a thin flat jet pattern. The mixture may be sprayed with water particles effectively dispersed in the direction of spray thickness.

The wall surfaces may extend longitudinally of the outlet edge, with inclined surfaces opposed to each other longitudinally of the outlet edge and diverging in the direction crossing the jetting direction as the inclined surfaces extend downstream with respect to the jetting direction.

As shown in FIG. 17, for example, this construction sprays a mixture of air and water, for example, in a thin flat jet pattern, with inclined surfaces 5*c* regulating spreading of gas-liquid mixture E longitudinally of the outlet edge 3 to stabilize spreading angle β.

The fluid discharge nozzle according to this invention may comprise a nozzle tip defining a spout for jetting fluid at a jet angle, and a groove extending along the outlet edge of the spout and defining a recessed surface recessed upstream with respect to the jetting direction from the outlet edge, to produce negative pressure regions therein when the fluid jets out of the spout.

As shown in FIG. 24, for example, this construction generates negative pressure regions 7 in groove 8 offset upstream of the outlet edge 3 with respect to the jetting direction. The fluid immediately after exiting the spout 1, particularly the gas expanding from a compressed state is readily drawn toward the negative pressure regions 7.

Thus, the fluid such as liquid, gas or a mixture of liquid and gas is positively dispersed due to the negative pressure regions. The fluid is discharged in an effectively dispersed state while maintaining a desired jet pattern.

The nozzle tip may have a reduced length in the jetting direction since the groove is formed along the outlet edge of the spout.

Where the fluid is liquid or a mixture of liquid and gas, the fluid is discharged while effectively dispersing the liquid into mist form.

Where the spout has an inlet end communicating with a passage converging toward the inlet end, the fluid having passed through the passage tends to flow into the spout in a state having velocity components crossing the jetting direction. Such velocity components cause the fluid entering the spout to jet out in a still more effectively dispersed state.

Where the groove surrounds an entire circumference of the outlet edge, it provides the advantage of effectively dispersing the entire fluid jetting out of the spout.

Where the recessed surface is curved inward as seen longitudinally of the groove, as shown in FIG. 24, for example, vortices 7*a* are generated in negative pressure regions 7 steadily along the curved surface 8*a*. Consequently, the negative pressure regions 7 may be formed in stable positions to promote stability of fluid dispersion.

Other features and advantages of this invention will be apparent from the following description of the preferred embodiments.

DETAILED DESCRIPTION OF THE PREFERRED EMBODIMENTS

Fluid discharge nozzles according to this invention will be described in detail with reference to the drawings.

[First Embodiment]

Figure 1:
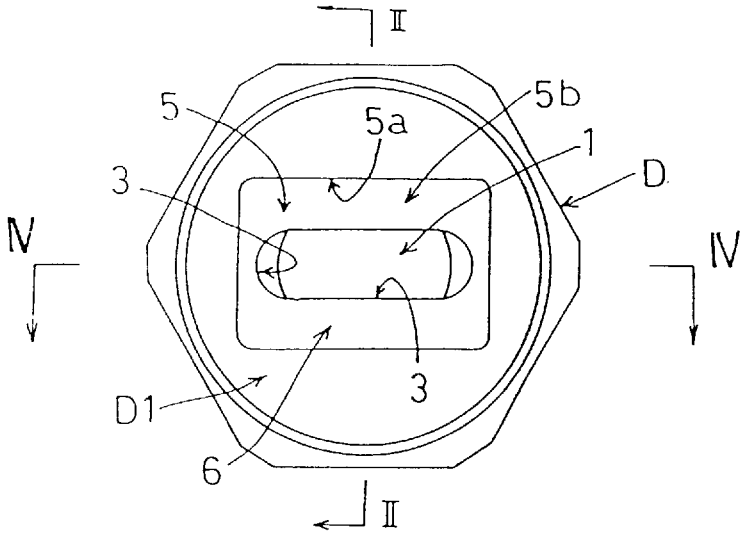
FIG. 1 is a front view of a nozzle body in a first embodiment of this invention.
Figure 2:
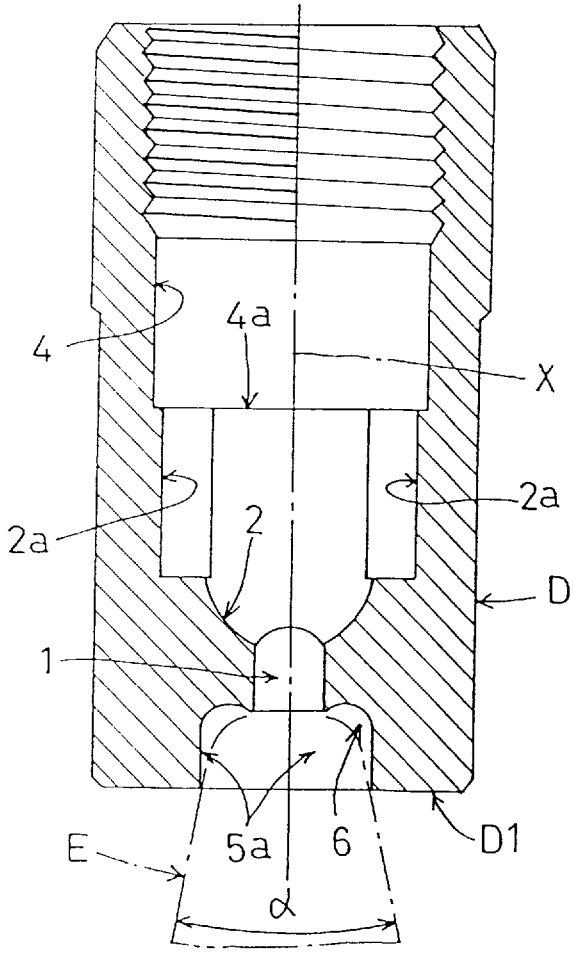
FIG. 2 is a section taken on line II—II of FIG. 1.
Figure 3:
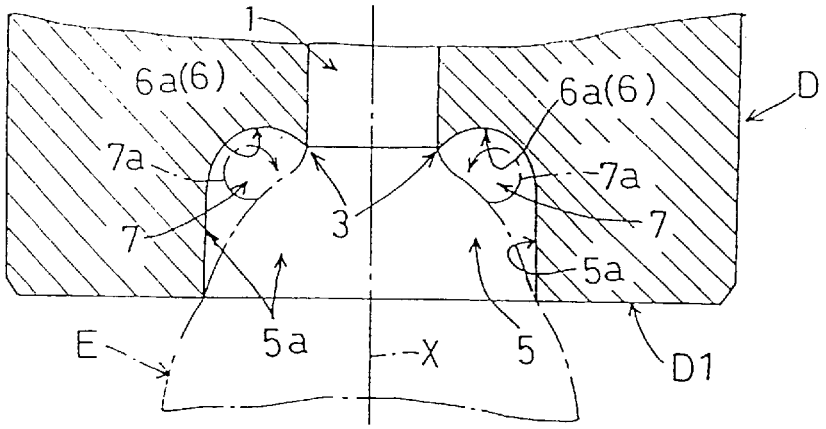
FIG. 3 is an enlarged section view of a principal portion of the nozzle body.
Figure 4:
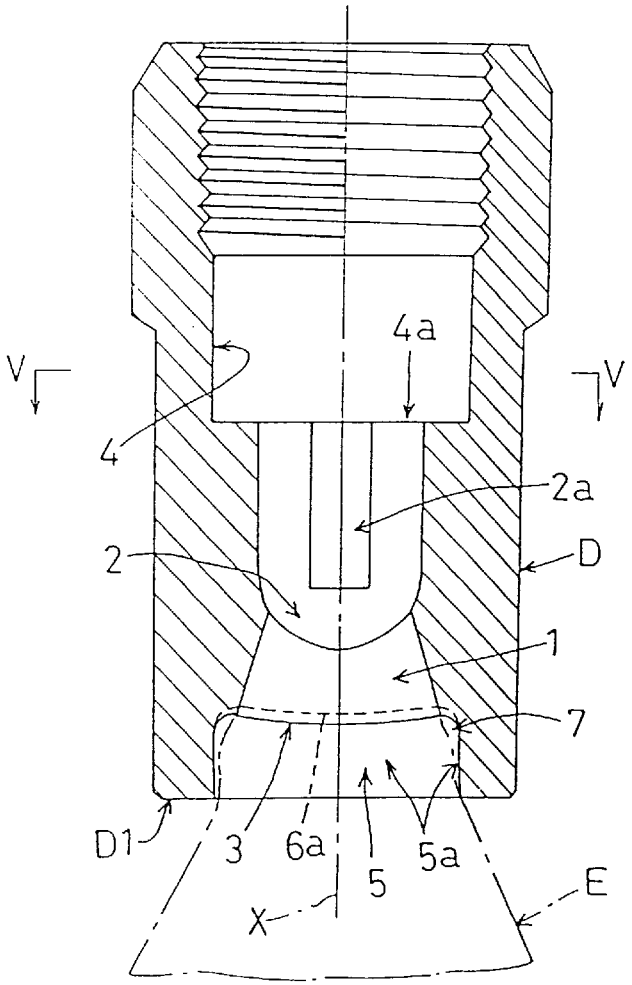
FIG. 4 is a section taken on line IV—IV of FIG. 1.
Figure 5:
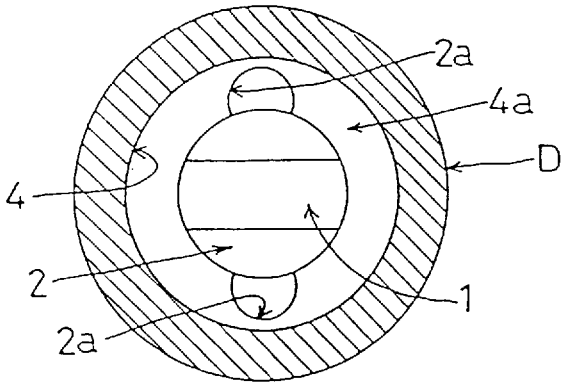
FIG. 5 is a section taken on line V—V of FIG. 4.
Figure 6:
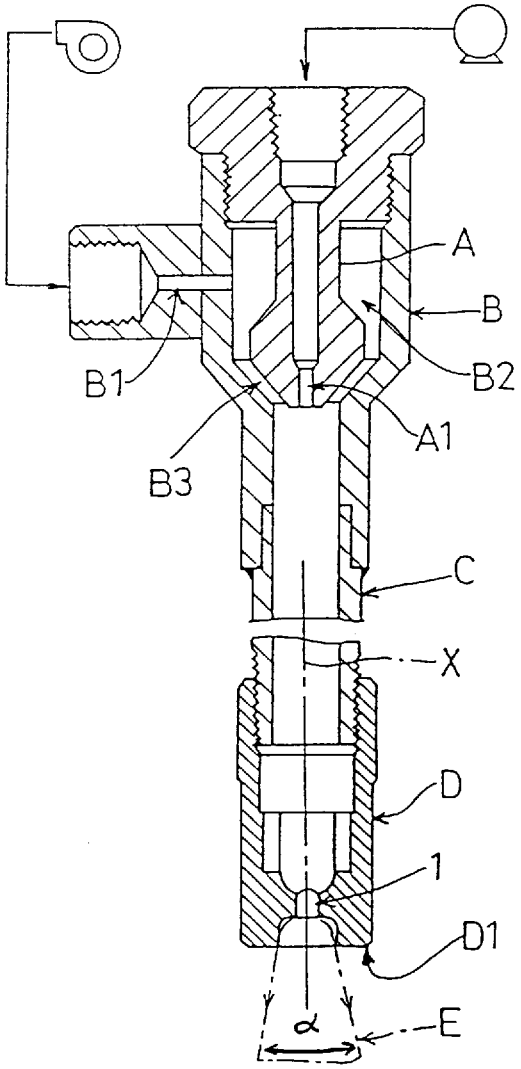
FIG. 6 is a sectional view, partly broken away, of a gas-liquid mixture spray nozzle.

FIG. 6 shows a gas-liquid mixture spray nozzle as one example of fluid discharge nozzles. This nozzle is used to spray a mixture E of air and water, which is one example of fluid, at a jet angle $\alpha$ toward rolled steel plate to cool the steel plate.

The gas-liquid mixture spray nozzle includes a water jet nozzle A having a water passage A1 of circular radial section for jetting out pressurized water, and a cylindrical body B having an air supply passage B1 for supplying pressurized air. The water jet nozzle A and cylindrical body B are arranged coaxially and screwed tight together. An annular air receiving space B2 is defined between an inner peripheral surface of the cylindrical body B and an outer peripheral surface of the water jet nozzle A. A cylindrical jet pipe C is rigidly connected to the cylindrical body B. A nozzle body D is screwed to a forward end of the jet pipe C to act as a nozzle tip. In the jet pipe C, the pressurized water jetting out of the water passage A1 mixes with the pressurized air jetting out of an annular passage B3 between a forward end of the water jet nozzle A and the cylindrical body B. The mixture E of air and water is sprayed from a slit-like spout 1 formed in the nozzle body D, in a thin flat sector pattern at jet angle $\alpha$ in a direction of thickness.

The nozzle body D defines a flat end surface D1 extending perpendicular to a nozzle axis X. As shown in FIGS. 1 through 5, the nozzle body D includes an inner passage 2 defining a curved inner peripheral surface extending along a circumference substantially concentric with the nozzle axis X and tapered so that a passage diameter thereof narrows toward an inlet side of the spout 1. The spout 1 is in the form of an orifice communicating with a forward end of the nozzle body D. The orifice 1 is elongated in a direction substantially perpendicular to the nozzle axis X. An outlet edge 3 elongated in the direction perpendicular to the jetting direction has arcuate ends in the longitudinal direction thereof as seen in side view, and arcuate ends in the longitudinal direction thereof as seen in front view also. A large diameter peripheral surface 4 larger than an inside diameter of the curved surface of inner passage 2 is formed upstream of the inner passage 2. A shoulder 4*a* is formed between the inner passage 2 having the curved surface and the large diameter peripheral surface 4.

Grooves 2*a* having a substantially arcuate section are cut in the inner passage 2 to extend along the nozzle axis X. The grooves 2*a* are opposed to each other in the direction crossing and in middle positions in the longitudinal direction of the orifice 1. The grooves 2*a* have downstream ends thereof disposed adjacent the orifice 1, and upstream ends opening at the shoulder 4*a*.

The forward end surface D1 of the nozzle body D defines a recess 5. The recess 5 has wall surfaces 5*a* extending further than the orifice 1 in the jetting direction from positions spaced from the outlet edge 3 of the orifice 1 in the direction crossing the jetting direction. The wall surfaces 5*a* have ends thereof in the jetting direction which contact free surfaces of the gas-liquid mixture E jetting out of the orifice 1 to generate negative pressure regions 7 inwardly of the wall surfaces 5*a*, i.e. inwardly of the recess 5.

The wall surfaces 5*a* extend parallel to the nozzle axis X or jetting direction, and surround an entire circumference of the outlet edge 3 of the orifice 1. Groove-like indents 6 are formed between the wall surfaces 5*a* and the outlet edge 3. The indents 6 define recessed surfaces 6*a* recessed upstream of the outlet edge 3. The recessed surfaces 6*a* are curved inward as seen in the longitudinal direction of the indents.

Figure 7:
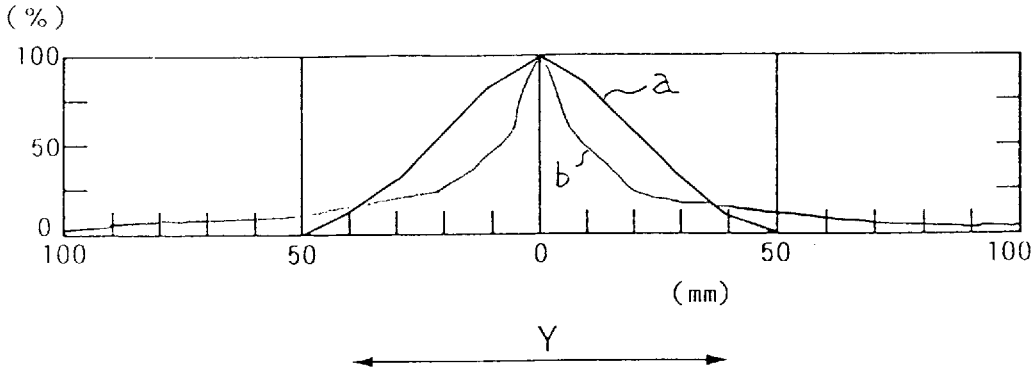
FIG. 7 is a graph showing a distributions of water.
Figure 8:
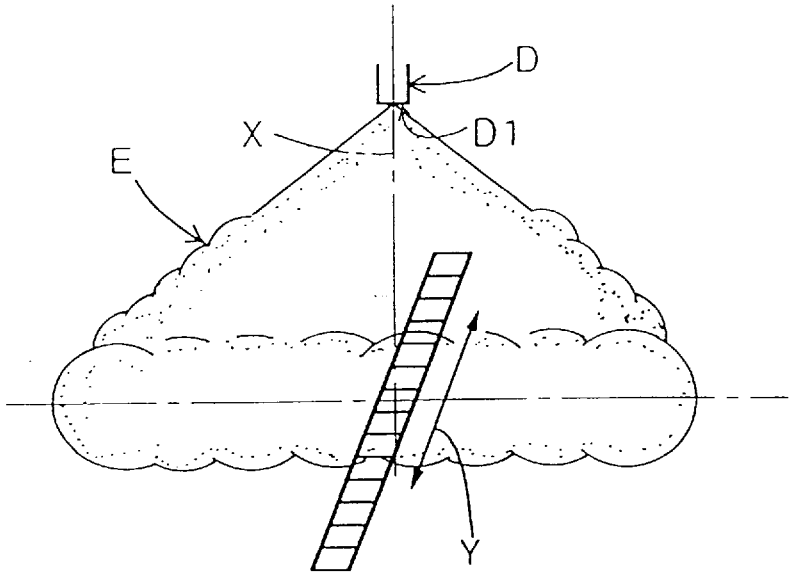
FIG. 8 is a schematic perspective view showing a testing method.

FIG. 7 shows results of measurement made of the gas-liquid mixture spray nozzle having the above nozzle body D defining the orifice 1. Specifically, the orifice 1 has a transverse dimension of approximately 4.0 mm throughout its length, the inlet edge is approximately 14.5 mm in the longitudinal direction thereof, and the outlet edge is approximately 21.5 mm in the longitudinal direction. As shown in FIG. 8, the gas-liquid mixture E of air and water is sprayed in a thin flat jet pattern, and measurement was made in a position approximately 113 mm from the end surface D1 along the nozzle axis X. FIG. 7 shows a liquid distribution in a direction of spray thickness Y crossing the longitudinal direction of the orifice. It will be seen that mixture E jets out with water particles dispersed in the direction of spray thickness Y while maintaining the flat sector jet pattern.

In FIG. 7, the vertical axis represents a liquid density with a maximum liquid quantity at 100. The horizontal axis represents positions in the direction of spray thickness Y from the nozzle axis X. The measurement was made with the conditions that air pressure was at 2.80 kgf/cm$^2$ G, water pressure at 3.15 kgf/cm$^2$, air quantity at 38.0 Nm$^3$/h, water quantity at 25.0 lit./min, and air-water volumetric ratio at 25.3.

[Second Embodiment]

Figure 9:
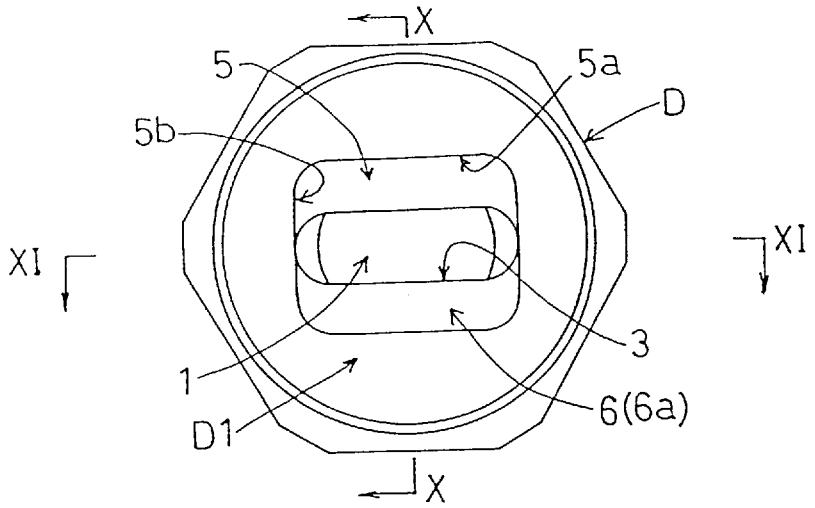
FIG. 9 is a front view of a nozzle body in a second embodiment of this invention.
Figure 10:
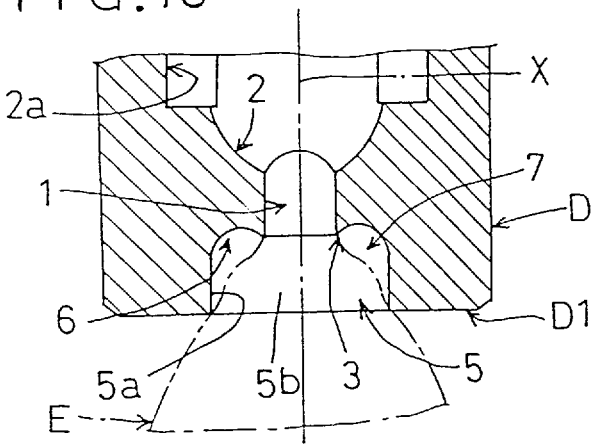
FIG. 10 is a section taken on line X—X of FIG. 9.
Figure 11:
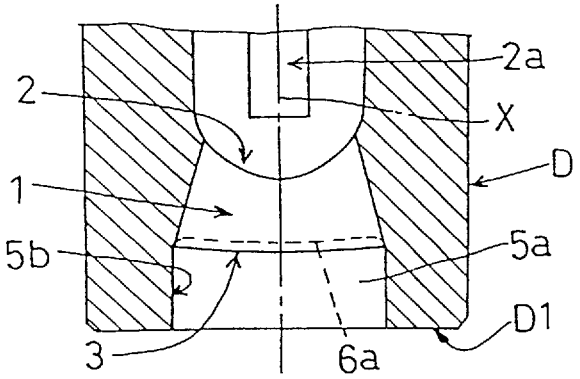
FIG. 11 is a section taken on line XI—XI of FIG. 9.

FIGS. 9 through 11 show a nozzle body D in another embodiment.

The nozzle body D includes wall surfaces 5*a* extending parallel to the jetting direction and arranged at opposite sides along the longitudinal direction of the outlet edge 3. The outlet edge 3 is partly surrounded by the wall surfaces 5*a*. End surfaces 5*b* extending parallel to the jetting direction are formed in opposite positions longitudinally of the outlet edge 3.

This embodiment is the same as the first embodiment in the other aspects.

[Third Embodiment]

Figure 12:
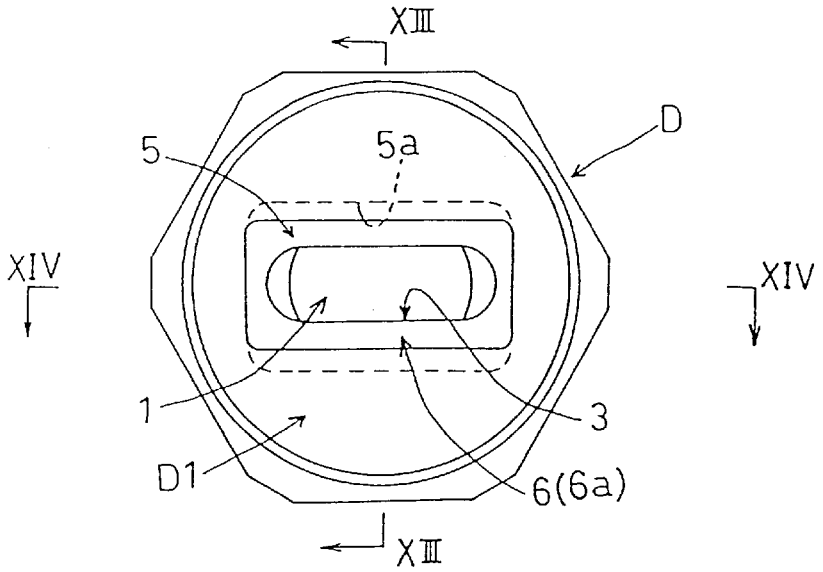
FIG. 12 is a front view of a nozzle body in a third embodiment of this invention.
Figure 13:
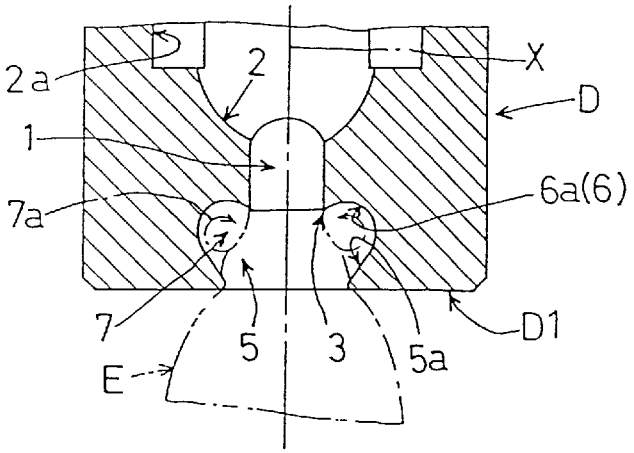
FIG. 13 is a section taken on line XIII—XIII of FIG. 12.
Figure 14:
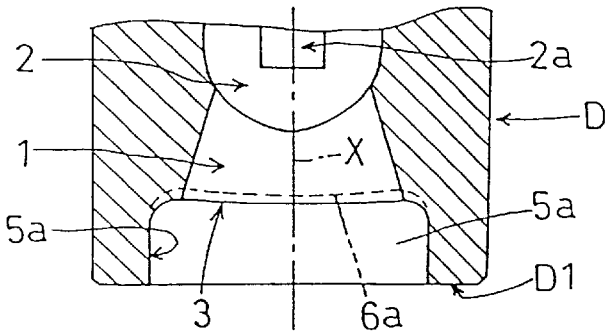
FIG. 14 is a section taken on line XIV—XIV of FIG. 12.

FIGS. 12 through 14 show a nozzle body D in a further embodiment. The nozzle body D includes wall surfaces 5*a* inclined to converge inwardly as they extend downstream with respect to the jetting direction, i.e. inclined to approach the nozzle axis X as they extend downstream.

The wall surfaces 5*a* are curved in the jetting direction to define recessed surfaces 6*a* curved inward as seen in the longitudinal direction of the indent. The recessed surfaces 6*a* are formed continuous with the wall surfaces 5*a*. The recess 5 diverges radially outwardly of the spout as it extends upstream with respect to the jetting direction.

This embodiment is the same as the first and second embodiments in the other aspects.

[Fourth Embodiment]

Figure 15:
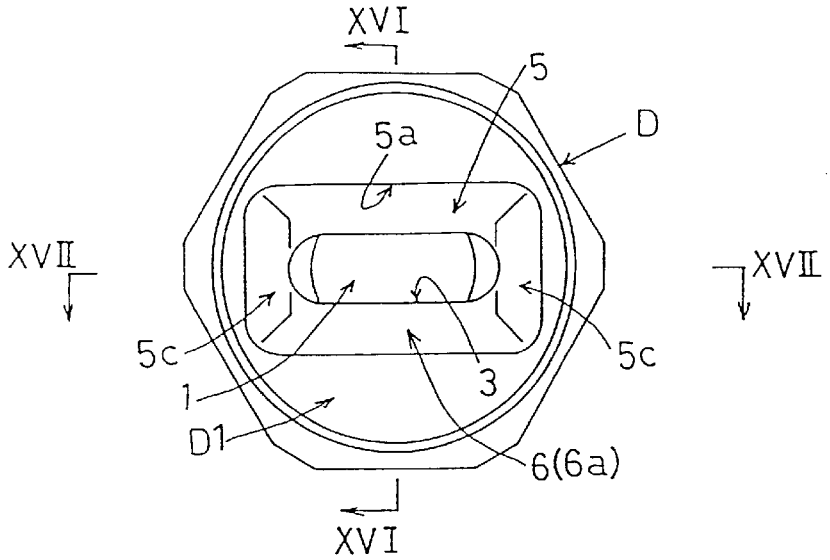
FIG. 15 is a front view of a nozzle body in a fourth embodiment of this invention.
Figure 16:
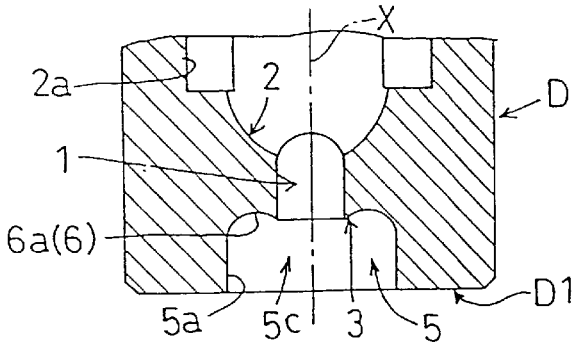
FIG. 16 is a section taken on line XVI—XVI of FIG. 15.
Figure 17:
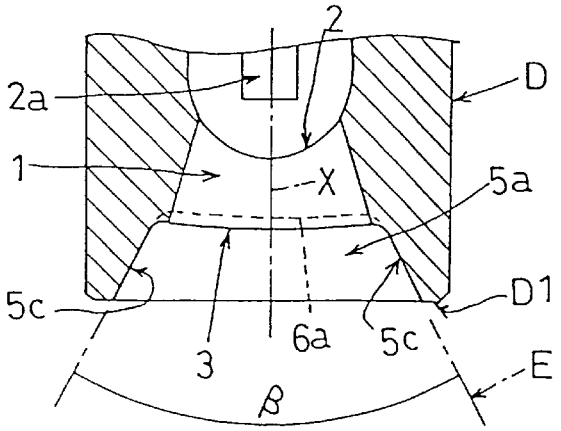
FIG. 17 is a section taken on line XVII—XVII of FIG. 15.

FIGS. 15 through 17 show a nozzle body D in a still further embodiment.

The nozzle body D includes wall surfaces 5*a* arranged at opposite sides along the longitudinal direction of the outlet edge 3. Inclined surfaces 5*c* are formed in opposite positions longitudinally of the outlet edge 3. The inclined surfaces 5*c* diverge downstream with respect to the jetting direction, in a direction crossing the jetting direction, i.e. radially outwardly of the orifice 1.

This embodiment is the same as the first, second and third embodiments in the other aspects.

[Fifth Embodiment]

Figure 18:
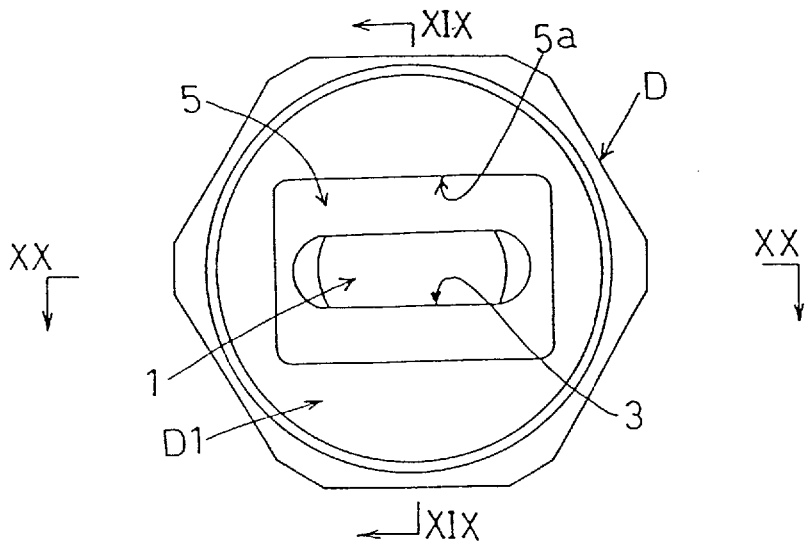
FIG. 18 is a front view of a nozzle body in a fifth embodiment of this invention.
Figure 19:
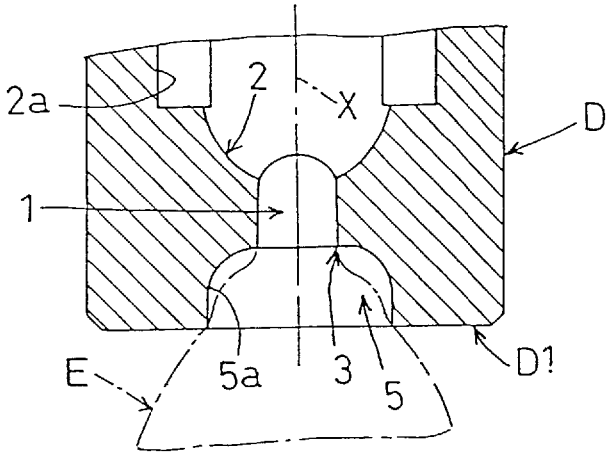
FIG. 19 is a section taken on line XIX—XIX of FIG. 18.
Figure 20:
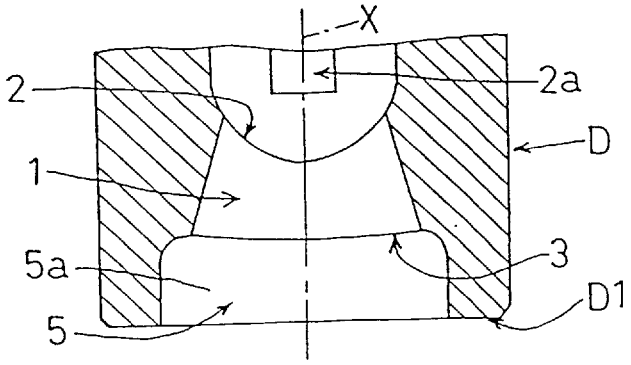
FIG. 20 is a section taken on line XX—XX of FIG. 18.

FIGS. 18 through 20 show a nozzle body D in a further embodiment.

Inwardly curved surfaces are formed between the wall surfaces 5*a* of the recess 5 and the outlet edge 3. The inwardly curved surfaces are indented radially outwardly of the orifice 1 as they extend downstream with respect to the jetting direction. This nozzle body D does not include the recessed surfaces 6*a* recessed upstream of the outlet edge 3 with respect to the jetting direction.

This embodiment is the same as the first embodiment in the other aspects.

[Sixth Embodiment]

Figure 21:
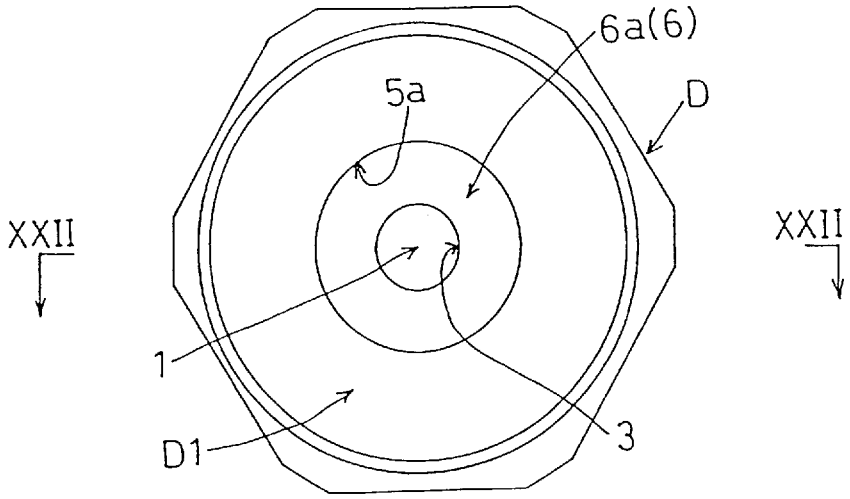
FIG. 21 is a front view of a nozzle body in a sixth embodiment of this invention.
Figure 22:
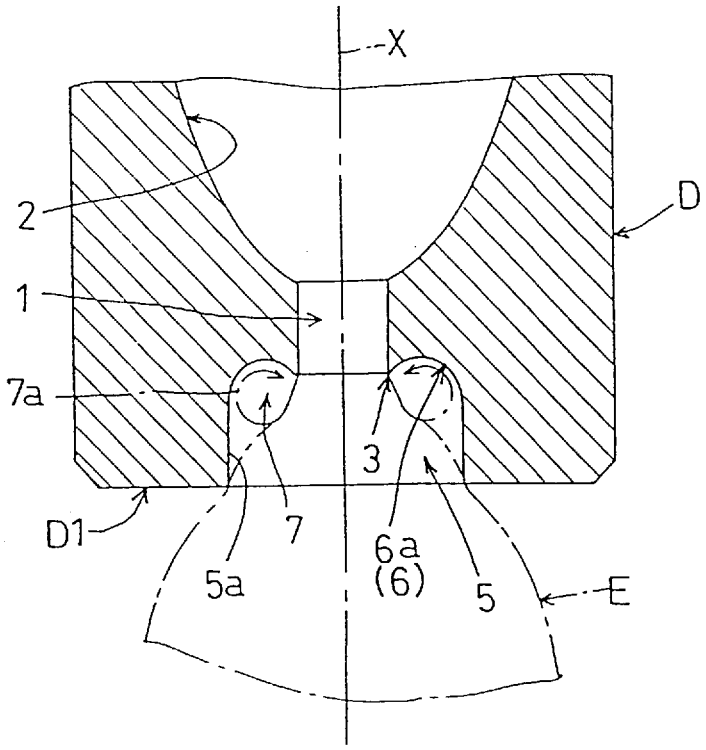
FIG. 22 is a section taken on line XXII—XXII of FIG. 21.

FIGS. 21 and 22 show a nozzle body D in a further embodiment.

The inner passage 2 of the nozzle body D has a curved and tapered inner peripheral surface extending along a circumference substantially coaxial with the nozzle axis X. An orifice 1 in the shape of a circular pipe is formed at a forward end of the inner passage 2 to extend along the nozzle axis X and act as a spout. The orifice 1 has a circular outlet edge 3. The gas-liquid mixture E is sprayed in a jet pattern having a circular section perpendicular to the jetting direction.

A recess 5 is spaced from the outlet edge 3 of the orifice 1 in directions crossing the jetting direction. The recess 5 has wall surfaces 5*a* extending further from the orifice 1 in the jetting direction. Negative pressure regions 7 are formed inwardly on the wall surfaces 5*a* when the gas-liquid mixture E jets out of the orifice 1.

The wall surfaces 5*a* extend parallel to the nozzle axis X or jetting direction, and surround the entire circumference of the outlet edge 3. Groove-like indents 6 are formed between the wall surfaces 5*a* and the orifice 1. The indents 6 define recessed surfaces 6*a* recessed upstream of the outlet edge 3.

In this embodiment, the gas-liquid mixture E may be caused to spin in flowing from the inner passage 2 to the orifice 1 before being sprayed therefrom.

This embodiment is the same as the first embodiment in the other aspects.

[Seventh Embodiment]

Figure 23:
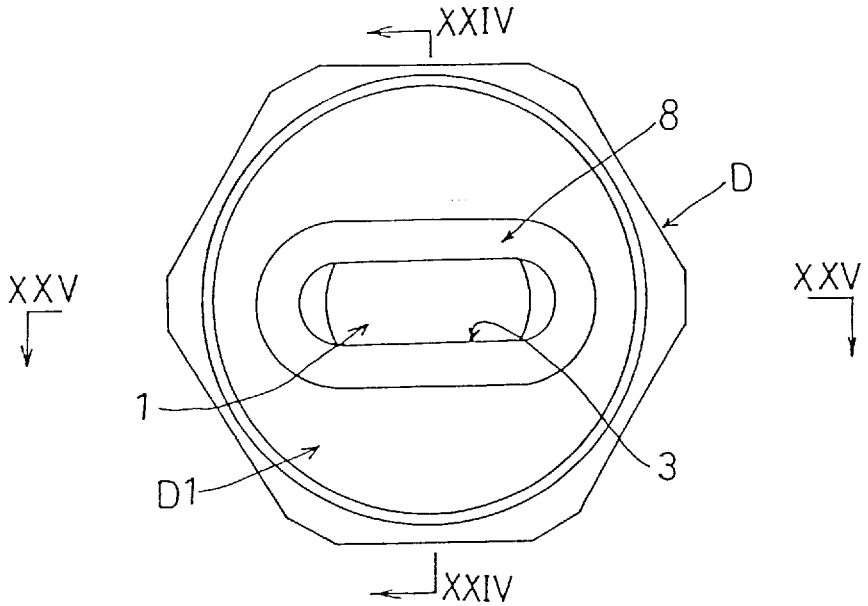
FIG. 23 is a front view of a nozzle body in a seventh embodiment of this invention.
Figure 24:
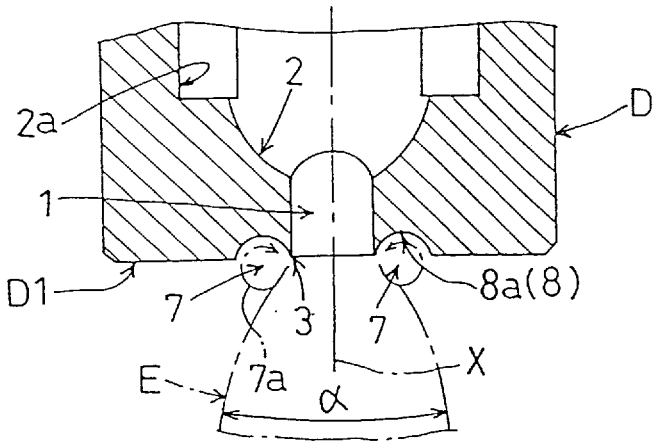
FIG. 24 is a section taken on line XXIV—XXIV of FIG. 23.
Figure 25:
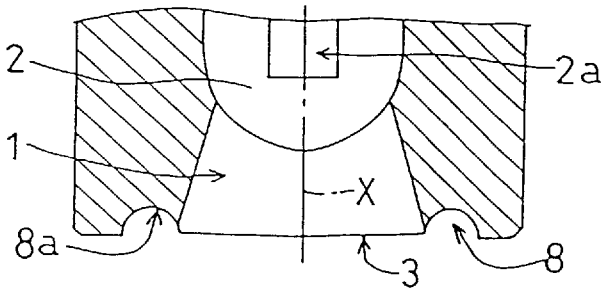
FIG. 25 is a section taken on line XXV—XXV of FIG. 23.
Figure 26:
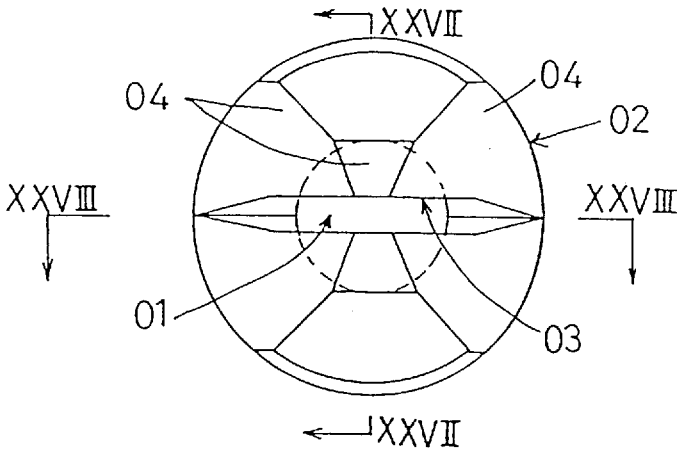
FIG. 26 (PRIOR ART)
FIG. 26 is a front view of a conventional nozzle body.
Figure 27:
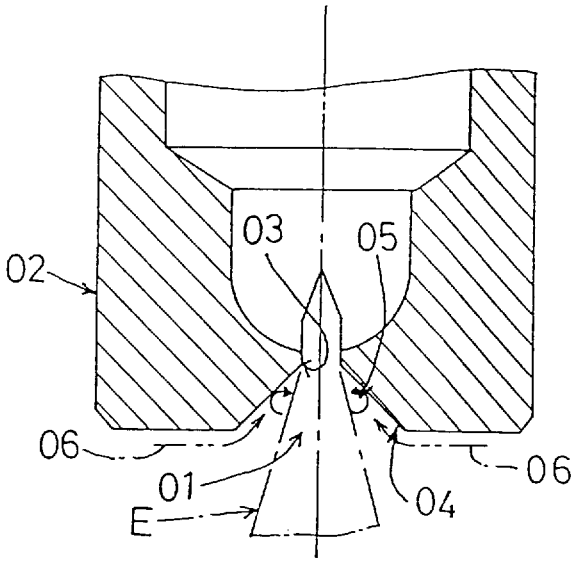
FIG. 27 (PRIOR ART)
FIG. 27 is a section taken on line XXVII—XXVII of FIG. 26.
Figure 28:
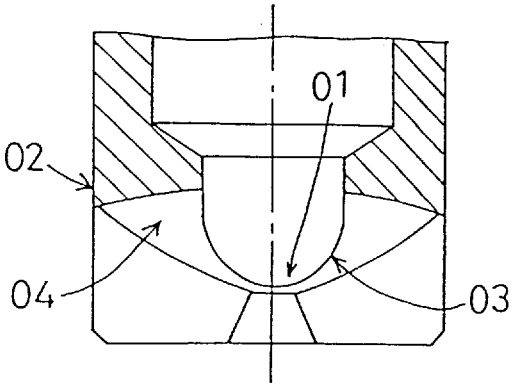
FIG. 28 (PRIOR ART)
FIG. 28 is a section taken on line XXVIII—XXVIII of FIG. 26.

FIGS. 23 through 25 show a nozzle body D in a further embodiment.

The nozzle body D has a groove 8 formed therein along the outlet edge 3 of the orifice 1. The groove 8 defines a recessed surface 8*a* recessed upstream with respect to the jetting direction from the outlet edge 3 of the orifice 1. Negative pressure regions 7 are formed in the groove 8 when the gas-liquid mixture E jets out of the orifice 1. The groove 8 surrounds the entire circumference of the outlet edge 3. The recessed surface 8*a* is curved inward as seen longitudinally of the groove.

This embodiment is the same as the first embodiment in the other aspects.

[Other Embodiments]

1. The fluid discharge nozzle according to this invention may be used to spray only a liquid such as water or only a gas such as air.

2. The wall surfaces extending further than the outlet edge of the spout in the jetting direction from positions spaced from the outlet edge in the direction crossing the jetting direction may not contact free surfaces of the gas-liquid mixture jetting out of the spout.

3. Plate-like walls may be disposed in positions spaced from the outlet edge of the spout in the direction crossing the jetting direction. The walls may have inner surfaces extending further than the spout in the jetting direction.

4. In the groove-like indents defining recessed surfaces recessed upstream of the outlet edge, the recessed surfaces may have flat surfaces crossing each other as seen longitudinally of the groove.

5. The wall surfaces extending further than the outlet edge of the spout in the jetting direction from positions spaced from the outlet edge in the direction crossing the jetting direction may meet the forward end surface of the nozzle to define an arcuate or acute-angled sectional shape.

6. The outlet edge of the spout may have an arcuate sectional shape.

7. The jet pattern of the fluid is not limited to a flat jet pattern or a jet pattern of circular section. The sectional shape in the radial direction of the spout may be varied to produce a jet pattern suitable to an intended purpose.

What is claimed is:

1. A fluid discharge nozzle, comprising:

a nozzle tip defining an inner passage;

a spout having an outlet edge formed in said nozzle tip for jetting fluid at a jet angle, the fluid jets having free surfaces;

wall surfaces defined by said nozzle tip and extending further than said spout in a jetting direction; and means for preventing ambient air from flowing inwardly between said wall surfaces and the free surfaces of the fluid jets emanating from said spout, said means including at least one recessed surface formed between said wall surfaces and said outlet edge, said at least one recessed surface recessed upstream of said outlet edge with respect to the jetting direction and formed as a concave surface from said outlet edge of said spout to said wall surfaces, whereby the fluid jets emanating from said spout produce negative pressure regions adjacent said at least one recessed surface.

2. A fluid discharge nozzle as defined in claim 1, wherein said fluid is liquid or a mixture of liquid and gas.

3. A fluid discharge nozzle as defined in claim 1, wherein said spout has an inlet end communicating with said inner passage, said inner passage tapering toward said inlet end.

4. A fluid discharge nozzle as defined in claim 3, wherein said wall surfaces are arranged to contact free surfaces of the fluid jetting out of said spout and to surround an entire circumference of said outlet edge, said wall surfaces extending parallel to the jetting direction, said outlet edge being elongated in a direction crossing the jetting direction.

5. A fluid discharge nozzle as defined in claim 1, wherein said wall surfaces surround an entire circumference of said outlet edge.

6. A fluid discharge nozzle as defined in claim 1, wherein said wall surfaces surround part of said outlet edge.

7. A fluid discharge nozzle as defined in claim 1, wherein said wall surfaces include portions extending parallel to a center axis of said spout.

8. A fluid discharge nozzle as defined in claim 1, wherein said wall surfaces are inclined inward in said jetting direction.

9. A fluid discharge nozzle as defined in claim 8, wherein said wall surfaces are curved inward in said jetting direction.

10. A fluid discharge nozzle as defined in claim 1, wherein said wall surfaces include portions for contacting the free surfaces of the fluid jetting out of said spout.

11. A fluid discharge nozzle as defined in claim 1, wherein said at least one recessed surface is a continuous curved surface.

12. A fluid discharge nozzle as defined in claim 1, wherein said outlet edge is elongated in a direction crossing said jetting direction.

13. A fluid discharge nozzle as defined in claim 1, wherein a groove extending along said outlet edge of said spout defines said at least one recessed surface, said groove surrounds an entire circumference of said outlet edge.

14. A fluid discharge nozzle as defined in claim 1, further including said inner passage having substantially arcuate grooves defined in walls of said passage, said grooves extending along a longitudinal axis of said nozzle tip.

15. A fluid discharge nozzle, comprising:

a nozzle tip defining an inner passage;

a spout having an outlet edge formed in said nozzle tip for jetting fluid at a jet angle, said jet angle extending in a direction of spray thickness which is normal to a longitudinal direction of said spout, the fluid jets having free surfaces;

wall surfaces defined by said nozzle tip and extending further than said spout in a jetting direction; and means for preventing ambient air from flowing inwardly between said wall surfaces and the free surfaces of the fluid jets emanating from said spout, said means including at least one recessed surface formed between said wall surfaces and said outlet edge, said at least one recessed surface being recessed upstream of said outlet edge with respect to the jetting direction and formed as a concave surface from said outlet edge of said spout to said wall surface, whereby the fluid jets emanating from said spout produce negative pressure regions adjacent said at least one recessed surface, and the negative pressure regions reducing density differences of the fluid jets across said jet angle.

16. A fluid discharge nozzle as defined in claim 15, wherein said spout has an inlet end communicating with said inner passage, said inner passage tapering toward said inlet end.

17. A fluid discharge nozzle as defined in claim 15, wherein said wall surfaces include portions for contacting the free surfaces of the fluid jetting out of said spout.

18. A fluid discharge nozzle as defined in claim 15, wherein said wall surfaces surround an entire circumference of said outlet edge.

19. A fluid discharge nozzle as defined in claim 15, wherein said wall surfaces surround part of said outlet edge.

20. A fluid discharge nozzle as defined in claim 15, wherein said wall surfaces include portions extending parallel to a center axis of said spout.

21. A fluid discharge nozzle as defined in claim 15, wherein said wall surfaces are inclined inward in the jetting direction.

22. A fluid discharge nozzle as defined in claim 15, wherein said wall surfaces are curved inward in the jetting direction.

23. A fluid discharge nozzle as defined in claim 15, wherein said at least one recessed surface is a continuous curved surface.

24. A fluid discharge nozzle as defined in claim 15, wherein a groove extending along said outlet edge of said spout defines said at least one recessed surface, said groove surrounds an entire circumference of said outlet edge.

25. A fluid discharge nozzle, comprising:

a nozzle tip defining an inner passage;

a spout having an outlet edge formed in said nozzle tip for jetting fluid at a jet angle, said jet angle extending in a direction of spray thickness which is normal to a longitudinal direction of said spout, the fluid jets having free surfaces;

wall surfaces defined by said nozzle tip and extending in the longitudinal direction of said spout and further than said spout in a jetting direction; and means for preventing ambient air from flowing inwardly between said wall surfaces and the free surfaces of the fluid jets emanating from said spout, said means including groove-like indents formed between said wall surfaces and said outlet edge, said indents having a pair of recessed surfaces curved inward as seen longitudinally of said indents, each said pair of recessed surfaces being recessed upstream of said outlet edge with respect to the jetting direction and formed as a concave surface from said outlet edge of said spout to said wall surfaces, whereby the fluid jets emanating from said spout produce negative pressure regions inwardly of a forward end surface of said nozzle tip, and the negative pressure regions reducing density differences of the fluid jets across said jet angle.

26. A fluid discharge nozzle as defined in claim 25, wherein said spout has an inlet end communicating with said inner passage, said inner passage tapering toward said inlet end.

27. A fluid discharge nozzle as defined in claim 25, wherein said wall surfaces include portions for contacting the free surfaces of the fluid jetting out of said spout.

28. A fluid discharge nozzle as defined in claim 25, wherein said wall surfaces surround an entire circumference of said outlet edge.

29. A fluid discharge nozzle as defined in claim 25, wherein said wall surfaces surround part of said outlet edge.

30. A fluid discharge nozzle as defined in claim 25, wherein said wall surfaces include portions extending parallel to a center axis of said spout.

31. A fluid discharge nozzle as defined in claim 25, wherein said wall surfaces are inclined inward in the jetting direction.

32. A fluid discharge nozzle as defined in claim 25, wherein said wall surfaces are curved inward in the jetting direction.

33. A fluid discharge nozzle as defined in claim 25, wherein said groove-like indents are a continuous concave curved surface.

34. A fluid discharge nozzle as defined in claim 25, wherein said groove-like indents surround an entire circumference of said outlet edge.

* * * * *

UNITED STATES PATENT AND TRADEMARK OFFICE

CERTIFICATE OF CORRECTION

PATENT NO. : 5,881,958

DATED : March 16, 1999

INVENTOR(S) : Hiroyoshi Asakawa and Akihiko Tanigaki

It is certified that error appears in the above-identified patent and that said Letters Patent is hereby corrected as shown below:

Column 12 Line 4 after claim 34, insert claim 35 as follows:

"--35. A fluid discharge nozzle as defined in claim 12, wherein said wall surfaces extend longitudinally of said outlet edge, with inclined surfaces opposed to each other longitudinally of said outlet edge and diverging in said direction crossing said jetting direction as said inclined surfaces extend downstream with respect to said jetting direction.--".

Signed and Sealed this

Fourteenth Day of September, 1999

*Attest:*

Q. TODD DICKINSON

*Attesting Officer*

*Acting Commissioner of Patents and Trademarks*